US008490425B2

(12) United States Patent
Irfan et al.

(10) Patent No.: US 8,490,425 B2
(45) Date of Patent: Jul. 23, 2013

(54) METHOD OF USING GLASS FOR SURFACE COOLING PROCESS AND A COOLING SURFACE

(75) Inventors: Nuri Coskun Irfan, Bursa (TR); Baris Koyas, Bursa (TR)

(73) Assignee: Evinoks Servis Ekipmanlari Sanayi Ve Ticaret Anonim Sirketi (TR)

( * ) Notice: Subject to any disclaimer, the term of this patent is extended or adjusted under 35 U.S.C. 154(b) by 1201 days.

(21) Appl. No.: 12/268,915

(22) Filed: Nov. 11, 2008

(65) Prior Publication Data

US 2009/0120119 A1 May 14, 2009

(30) Foreign Application Priority Data

Nov. 12, 2007 (TR) ..... a 2007 07764

(51) Int. Cl.
*F25D 23/00* (2006.01)

(52) U.S. Cl.
USPC ..... 62/264

(58) Field of Classification Search
USPC ..... 62/259.1, 264, 515; 29/700
See application file for complete search history.

(56) References Cited

U.S. PATENT DOCUMENTS

| | | | | |
|---|---|---|---|---|
| 2,034,149 | A * | 3/1936 | Munters | 62/515 |
| 2004/0177636 | A1 * | 9/2004 | Jolly | 62/259.1 |
| 2007/0062677 | A1 * | 3/2007 | Usui et al. | 165/150 |

FOREIGN PATENT DOCUMENTS

| | | | |
|---|---|---|---|
| DE | 100 61 201 | A1 | 6/2002 |
| DE | 203 10 343 | U1 | 10/2003 |
| GB | 2438688 | A | 12/2007 |
| WO | 2007/037740 | A1 | 4/2007 |

* cited by examiner

*Primary Examiner* — Melvin Jones
(74) *Attorney, Agent, or Firm* — Akerman Senterfitt

(57) ABSTRACT

The invention relates to a cooling surface arrangement, which provides cooling in places where food should be cooled and kept cold by means of cooling pipes (5) connected to the cooling surface in which cooling liquid passes where there is cooling pipes (5) which may be made of copper, at least one bottom glass (3) connected to the cooling pipes (5), at least one upper glass (1) to be used as a service surface, and glue (2) to fix these upper and bottom glasses under high pressure.

8 Claims, 1 Drawing Sheet

METHOD OF USING GLASS FOR SURFACE COOLING PROCESS AND A COOLING SURFACE

TECHNICAL AREA

The invention relates using glass as a cooling area for cooling food and keeping it cold where necessary, getting a cooled surface in warehouses whether it requires special service or not, or providing cooling system in all requested areas.

The invention relates in particular using glass as a cooling area for cooling food on open buffets, on food and beverage service lines and stations, on fruits, fish, and meat display stands, on mobile or fixed cooling service and display trolleys where food has to be kept cool.

THE KNOWN STATE OF THE TECHNIQUE

Several materials are used as cold surface in storing and displaying food which must be served cold to the customer. These materials which are directly in touch with the food, must comply with several standards in terms of health and usage. Stainless steel surfaces can be regarded as an example to the known state of the technique. Cooling surfaces and cooling wells made from stainless steel are not suitable for proper presentation because of their look and material. Possibility of forming of scratches and deformation of such surfaces, is a negative charactheristic of this material and this can create problems in terms of health regulations. Apart from the above, there is no color alternative for these surfaces and only one color can be used. Besides, as permeability of light of this material is low, such surfaces are not suitable for decorative illumination. Stainless steel surfaces currently used can easily be scratched and deformed by the materials put on them. However, there is not any similar problem when we consider glass surfaces.

Today, natural stones such as granite, marble and travertine are among the other applicable materials used as cold surface. As temperature on the surface of these materials drops down below zero degree in cooling process, the moisture in the environment forms ice on the surface. The water formed during and after melting of the frost is absorbed by these natural stones. The water absorbed within these stones then freezes during the cooling processes ongoing. The freezed water expands by volume inside the stones, and creates tension inside the stone, which may form cracks on these natural stones in course of time. Although such surfaces may be modified by some treatments to be impermeable, this effect may lose its efficiency in time. On the other hand, such stones are not suitable in terms of hygiene because of their perforated structures. And as the heat conduction losses are high in such materials due to their thickness, usage of these natural stones as cold surfaces is not convenient in terms of energy consumption. In technique, there are some specific applications for the cooling surfaces which are designed to maintain constant low temperature for the food cooled in especially open buffets/display stands or at home. For example the patent application number WO2007037740 A1 is about an application to serve the food in desired low temperatures even in an environment of room temperature. Technically, several materials and applications used as cool surfaces to maintain desired temperature for the food that has to be served cold on open buffets and service stations, have some disadvantages in terms of criteria such as energy consumption, hygiene and long life. The obligation to stick to the natural characteristics such as color and shape of the materials used as cool surfaces, is a burden for the manufacturers. However, when glass is used as cooling surface, there will be no restrictions in color, shape and lighting.

Today, another material used in cooling surface applications is the one based on acrylic or polyester. As the expansion of these materials is high, they may form unwanted deformation during cooling and along with this, the chemical and physical durability of the acrylic based or polyester material is not as strong as glass.

In parallel of the information above, it's obvious that convenience of manufacturing and usage and low costs are very important. But because of the obligation to stick to some specific characteristics of several materials (cracking due to water absorbtion and high energy consumption of the natural stones, decorative inconvenience of the stainless steel due to restrictions of color and shape, etc.), the cost is high and it is inconvenient to use the current applications.

When previous technical documents and current applications are examined in detail, no application about the usage of specially produced glass which ensures higher physical durability and lower energy consumption as cooling surface has been found.

As a result, the need for a cooling surface which is thinner, more healthy and more convenient for the decoration of presentation and insufficiency of the present solutions in this field have all made it obligatory to make a technical improvement in the related field.

BRIEF DESCRIPTION OF THE INVENTION

The present invention relates to a method using glass for cooling surface and a cooling surface that fulfills all the aforesaid requirements, eliminates all the disadvantages and provides some additional advantages.

The object of the invention is to use different colors of glass and polyvin which is used in between the two glass while lamination to obtain different colors as opposed to the stainless steel that is currently used as cooling surfaces.

On the other hand, as glass cooling surface is permeable for light, there is a possibility to make the presentation more decorative by using light sources underneath or at the sides.

Another object of the invention is to make several light tricks and visual effects by using light sources underneath or at the sides of glass.

Also, the object of the invention is to make glass more durable against scratches and deformation and have a longer life when compared to stainless steel cooling surfaces.

As mentioned above, the object of the invention is to prevent the glass from having tension and cracking problems as opposed to natural stones because there is no possibility of absorbtion of the melted water by the glass.

The object of the invention is to have a structure of glass that is much thinner than the ones in current applications. For example, when granite or marble is used as cooling surface, the material thickness is minimum 2 cm whereas this value decreases to 1 cm in glass applications.

As glass is thinner and the conduction multiplier is stronger than the existing applications, the purpose of the invention is to prevent high energy consumption.

Another object of the invention is to ensure the desired temperature on top surface in a shorter time.

In order to achieve the above mentioned objectives, the invention relates to a cooling surface arrangement, which provides cooling in places where food should be cooled and kept cold by means of cooling pipes connected to the cooling surface in which cooling liquid passes characterized in that it comprises at least one bottom glass connected to the cooling pipes, at least one upper glass to be used as a service surface and glue to fix these upper and bottom glasses under high pressure.

In order to achieve the above mentioned objectives, the invention comprising the steps of; sandblasting of the bottom glass which is connected to the cooling pipes to ensure better fixing; tempering operation of the upper and bottom glass to increase their strength; the fixing of the upper and bottom glass under pressure by means of glue.

The application is done by sticking the cooling pipes to the sandblasted bottom surface of the bottom glass by means of stick tape. These stick tapes also conduct the cold air onto surfaces where the cooling pipe does not have any direct connection with the glass.

In a preferred embodiment of the invention, the cooling pipes are pressed to increase the cooling surface on the bottom glass.

In a preferred embodiment of the invention, isolation material is used in the space between cooling pipes and outer sheet in order to obtain cooling only on the desired glass surface.

In a preferred embodiment of the invention, there are light sources underneath and on the sides of the surface to obtain light tricks and visual effects.

The present invention which is briefly explained above and will be explained in detail below, consists of many conveniences due to the specifications mentioned.

The structural and characteristic features and all the advantages of the invention will be more clearly understood from the figures provided below and the detailed description written with reference to these figures, and therefore, the evaluation must be made taking into consideration said figures and detailed description.

BRIEF DESCRIPTION OF THE FIGURES

In order to best understand the embodiment of the present invention and the advantages thereof along with the additional elements, it must be considered together with the figures the descriptions of which are provided below.

REFERENCE NUMBERS

Figure 1:
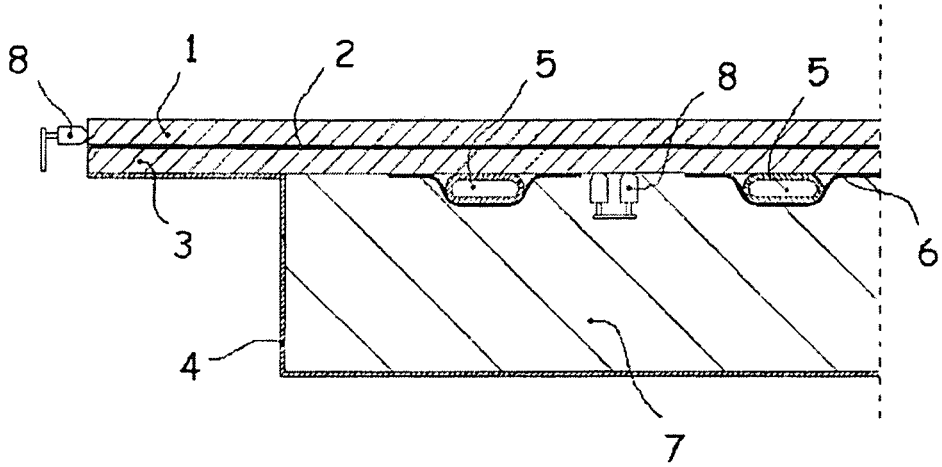
FIG. 1 refers to the cross section of the glass which is used as cooling surface.

1. Upper glass
2. Glue
3. Bottom glass
4. Outer sheet
5. Cooling pipe
6. Stick tape
7. Isolation material
8. Light source

DETAILED DESCRIPTION OF THE INVENTION

In this detailed description, the preferred embodiments of the cooling surface subject to invention and the method of using glass for surface cooling according to the invention are disclosed for the sole purpose of ensuring a better understanding of the subject, without any limiting effect.

Figure 2A:
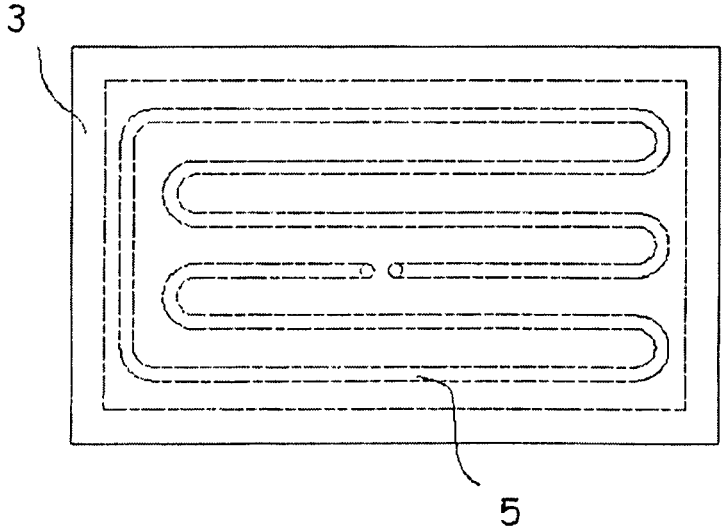
FIG. 2*a* refers to the section showing copper pipe application under the bottom surface of the bottom glass.
Figure 2B:
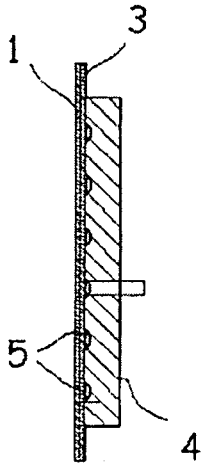
FIG. 2*b* refers to the vertical side elevation of the glass which is used as cooling surface equalized in FIG. 2*a*.

FIG. 1 refers to the cross section of the glass which is used as cooling surface. This invention is predicated on usage of glass as cooling surface. The glass used on this system (1,3) has been processed under certain operations. In this method of invention an upper glass (1) and a bottom glass (3) have been used. The upper glass (1) forms the upper part where service is given. The bottom glass (3) on the other hand refers to the one on which copper pipes (5) are sticked. Copper pipes (5) are used as cooling pipe due to their physical/chemical features. In this process first of all, the bottom part of the bottom glass (3) is sandblasted so that the sticking tape (6) and isolation material (7) sticks better on this surface. Then, the bottom glass (3) and the upper glass (1) are tempered. Tempering of the glass is basically done by first heating the glass to the point of tempering temperature and then suddenly cooling it, which reinforces the glass surface. Polyvin (2) is used inbetween the tempered glass (1,3) as sticking material. The tempered glass (1,3) are sticked together with polyvin (2) under high temperature in an oven. The polyvin (2) is the material that combines the upper and bottom glass (1,3) under high pressure in an oven. This method of sticking two glass in an oven is also known as laminate application. The copper pipes (5) are sticked with a tape (6) under the sandblasted bottom part of the bottom glass (3). This application has been shown in detail in FIG. 2*a* and FIG. 2*b*. Normally the copper pipes in which the cooling liquid moves and which is sticked under the glass have circular section. However, to get the effective cooling and cover more area on the cooling surface, they are given shape as seen in detail in the figures by being pressed. Therefore, the copper pipe (5) has more effect on the bottom part of the bottom glass (3). These copper pipes (5) are sticked under the bottom glass (3) surface with an aluminum tape (6). In this way the cooling system ensures that the parts of the copper pipe (5) which do not directly touch the surface of the bottom glass (3) give the cooling effect with this aluminum tape (6). After the copper pipes (5) are sticked under the bottom glass (3) surface, the outer sheet (4) is closed. After the sheet (4) is closed, the space between the copper pipes (5) and the sheet (4) is filled with isolation material (7). The said isolation material (7) is chemical polyurethane which is made by a chemical reaction of isosynate and alcohol. The polyurethane (7) serves as an isolation element by isolating the cold air from the back part of the glass in order to keep cold air only on glass surfaces (1,3). The frequency of the copper pipes (5) and the way they are laid under the glass surface (1) is determined as per the area which is to be cooled.

Alternatively, light sources (8) are used under and/or at sides of the cooling system subject to invention in order to give visual effects on the cooling surface.

The invention must be interpreted based on the protective scope thereof as specified in the claims, the above written detailed descriptions and the alternative embodiments thereof. The protective scope of this application is determined in the section of claims and the scope may by no means be limited to the description above provided only for exemplary purposes. It is obvious that a person skilled in the art may provide the innovation put forward by the invention also by using the similar embodiments and/or apply this embodiment to other fields with similar purpose used in the relevant art. Consequently, such embodiments would obviously lack the criteria of innovative step and exceeding the known state of the art.

The invention claimed is:

1. A surface cooling method, which provides cooling in places where food should be cooled and kept cold by means of cooling pipes connected to the cooling surface in which cooling liquid passes, said method comprising:

sandblasting the cooling pipes and the bottom glass in order to ensure better sticking;

tempering the upper glass and bottom glass in order to reinforce them; and connecting the bottom glass and upper glass together with glue under high pressure.

2. The surface cooling method according to claim 1, wherein said cooling pipes are connected to the bottom part of the said bottom glass which is sandblasted with a sticking tape and in this way the cooling system ensures that the parts of the copper pipe which do not directly touch the surface of the bottom glass give the cooling effect with the sticking tape.

3. The surface cooling method according to claim 1, wherein the cooling pipes in which the cooling liquid passes are pressed in order to increase the cooling area on the bottom glass.

4. The surface cooling method according to claim 1, wherein after the copper pipes are connected under the said bottom glass surface, the outer sheet is closed.

5. The surface cooling method according to claim 1, wherein the space between the copper pipes and the sheet is filled with isolation material by isolating the cold air from the back part of the glass in order to keep cold air only on glass surfaces.

6. The surface cooling method according to claim 5, wherein the isolation material which fills the space between the copper pipes and the sheet is polyurethane.

7. A cooling surface arrangement, which provides cooling in places where food should be cooled and kept cold by means of cooling pipes connected to the cooling surface in which cooling liquid passes, comprising:

at least one bottom glass connected to the cooling pipes, at least one upper glass to be used as a service surface and glue to fix these upper and bottom glasses under high pressure, wherein the glue which provides sticking between upper glass and bottom glass is polyvin.

8. The cooling surface arrangement according to claim 7, comprising light sources used under and/or at sides of the cooling system in order to give visual effects on the cooling surface.

* * * * *